US005405065A

United States Patent [19]

Olson

[11] Patent Number: 5,405,065

[45] Date of Patent: Apr. 11, 1995

[54] COLLAPSIBLE PORTABLE RADIAL CLOTHES HANGER

[76] Inventor: Donna K. Olson, R.R. 1, Box 76A, Joice, Iowa 50446

[21] Appl. No.: 164,718

[22] Filed: Dec. 10, 1993

[51] Int. Cl.[6] ..... A47G 25/40

[52] U.S. Cl. ..... 223/9 D; 223/89; 223/85; 223/DIG. 4

[58] Field of Search ..... 223/85, 84, 91, 64, 223/DIG. 4; 135/33.5, 37; 248/188.6, 439; 211/7, 62

[56] References Cited

U.S. PATENT DOCUMENTS

| | | | |
|---|---|---|---|
| 532,953 | 1/1895 | Grimes | 211/162 |
| 988,240 | 3/1911 | Barnes Jr. | 135/37 |
| 4,586,524 | 5/1986 | Smith | 223/94 |
| 4,739,912 | 4/1988 | Klawieter et al. | 223/85 |

*Primary Examiner*—Clifford O. Crowder
*Assistant Examiner*—Bibhu Mohanty

[57] ABSTRACT

A portable clothes hanger to suspend articles of clothing for drying, displaying, or storing purposes. The hanger includes a center support member which may be suspended from a shower curtain rod, a door, or other fixture. A base is coupled to the lower end of the center support member and a plurality of arms are pivotally coupled around the base. The arms may be positioned in a parallel relationship with the center support member for travelling or storage, or pivoted into a nearly horizontal, radially extending position such that articles of clothing and the like may be draped over each arm. A pair of clips are slidably disposed on each arm and are operable to secure such articles to their respective arms.

7 Claims, 3 Drawing Sheets

COLLAPSIBLE PORTABLE RADIAL CLOTHES HANGER

BACKGROUND OF THE INVENTION

1. Field of the Invention

The present invention relates to hangers and more particularly pertains to a collapsible portable radial clothes hanger which may be utilized to suspend articles of clothing for drying, displaying, or storing purposes.

2. Description of the Prior Art

The use of hangers is known in the prior art. More specifically, hangers heretofore devised and utilized for the purpose of suspending articles are known to consist basically of familiar, expected and obvious structural configurations, notwithstanding the myriad of designs encompassed by the crowded prior art which have been developed for the fulfillment of countless objectives and requirements.

For example, a multiple stackable swingable non-slip cantilever pants hanger system is illustrated in U.S. Pat. No. 5,165,555 which includes a channel-shaped ledger beam wall support and a plurality of swingable pants hangers pivotally coupled to the wall support. The support may be secured to a vertical wall, whereby the hangers will extend orthogonally and pivotally therefrom to support pants or skirts or similar clothes which may be suspended thereover.

Another patent of interest is U.S. Pat. No. 4,366,909 which discloses a clothes hanger with multiple clothes supports. The hanger includes a pair of U-shaped members which are pivotally connected to the end of a support rod having a hook which allows the support rod to be suspended from a fixture. The U-shaped members can be pivoted relative to the support rod so as support articles of clothing in various positions.

Other known prior art hangers include U.S. Pat. No. 5,072,837, and U.S. Pat. No. 324,785.

While these devices fulfill their respective, particular objectives and requirements, the aforementioned patents do not disclose a portable clothes hanger to suspend articles of clothing for drying, displaying, or storing purposes which includes a center support member, a base coupled to a lower end of the center support member, and a plurality of arms pivotally coupled around the base, whereby the arms may be pivoted into a nearly horizontal, radially extending position such that articles of clothing and the like may be draped thereover.

In this respect, the collapsible portable radial clothes hanger according to the present invention substantially departs from the conventional concepts and designs of the prior art, and in so doing provides an apparatus primarily developed for the purpose of suspending articles of clothing for drying, displaying, or storing purposes.

SUMMARY OF THE INVENTION

In view of the foregoing disadvantages inherent in the known types of hangers now present in the prior art, the present invention provides a new collapsible portable radial clothes hanger construction wherein the same can be utilized to suspend articles of clothing for drying, displaying, or storing purposes. As such, the general purpose of the present invention, which will be described subsequently in greater detail, is to provide a new collapsible portable radial clothes hanger apparatus which has many of the advantages of the hangers mentioned heretofore and many novel features that result in a collapsible portable radial clothes hanger which is not anticipated, rendered obvious, suggested, or even implied by any of the prior art hangers, either alone or in any combination thereof.

To attain this, the present invention essentially comprises a portable clothes hanger to suspend articles of clothing for drying, displaying, or storing purposes. The hanger includes a center support member which may be suspended from a shower curtain rod, a door, or other fixture. A base is coupled to the lower end of the center support member and a plurality of arms are pivotally coupled around the base. The arms may be positioned in a parallel relationship with the center support member for travelling or storage, or pivoted into a nearly horizontal, radially extending position such that articles of clothing and the like may be draped over each arm. A pair of clips are slidably disposed on each arm and are operable to secure such articles to respective arms.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible portable radial clothes hanger apparatus which has many of the advantages of the hangers mentioned heretofore and many novel features that result in a collapsible portable radial clothes hanger which is not anticipated, rendered obvious, suggested, or even implied by any of the prior art hangers, either alone or in any combination thereof.

It is another object of the present invention to provide a new collapsible portable radial clothes hanger which may be easily and efficiently manufactured and marketed.

It is a further object of the present invention to provide a new collapsible portable radial clothes hanger which is of a durable and reliable construction.

An even further object of the present invention is to provide a new collapsible portable radial clothes hanger which is susceptible of a low cost of manufacture with regard to both materials and labor, and which accordingly is then susceptible of low prices of sale to the consuming public, thereby making such collapsible portable radial clothes hangers economically available to the buying public.

Still yet another object of the present invention is to provide a new collapsible portable radial clothes hanger which provides in the apparatuses and methods of the prior art some of the advantages thereof, while simultaneously overcoming some of the disadvantages normally associated therewith.

Still another object of the present invention is to provide a new collapsible portable radial clothes hanger which may be utilized to suspend articles of clothing for drying, displaying, or storing purposes.

Yet another object of the present invention is to provide a new collapsible portable radial clothes hanger which includes a center support member, a base coupled to the lower end of the center support member, and a plurality of arms pivotally coupled around the base, whereby the arms may be positioned in a parallel relationship with the center support member for travelling or storage, or pivoted into a nearly horizontal, radially extending position such that articles of clothing and the like may be draped over each arm.

Even still another object of the present invention is to provide a new collapsible portable radial clothes hanger which further includes a pair of clips slidably disposed on each arm for securing articles of clothing to each arm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
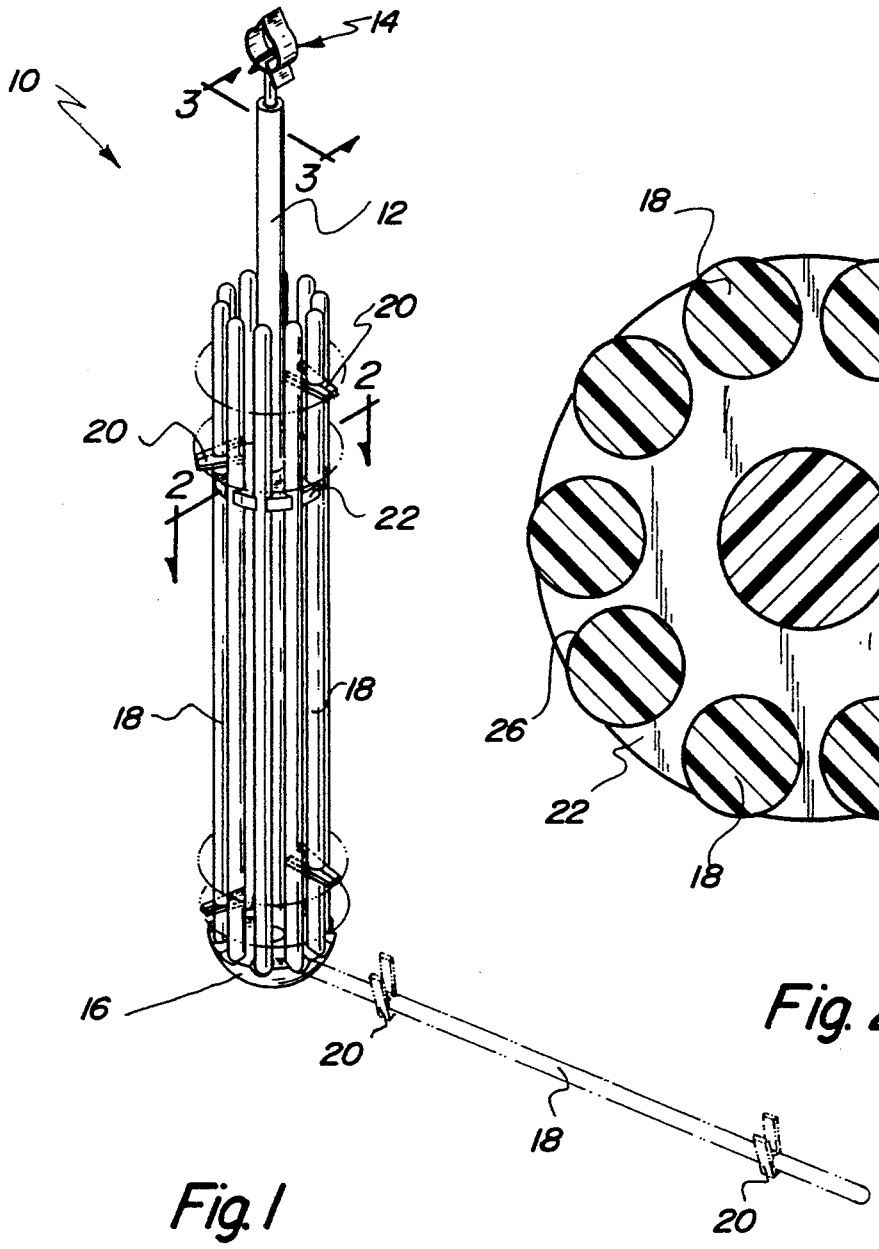
FIG. 1 is a perspective view of a collapsible portable radial clothes hanger comprising the present invention.

With reference now to the drawings, and in particular to FIGS. 1–6 thereof, a new collapsible portable radial clothes hanger embodying the principles and concepts of the present invention and generally designated by the reference numeral 10 will be described.

From an overview standpoint, the collapsible portable radial clothes hanger 10 comprises a central support member 12 which is provided with a clamping hanger 14 at a top end thereof which allows the center support member to be suspended from a shower curtain rod, a ceiling hook, a clothes line, a ceiling joist, or other similar fixtures. A base 16 is fixedly secured to a lower end of the center support member 12. A plurality of elongated arms 18 are each pivotally connected at an end thereof around a perimeter of the base 16, as best illustrated in FIG. 1. Because of their pivotal connection to the base 16, the arms 18 may be positioned into a parallel relationship with respect to the center support member 12 for travelling or storage, or pivoted into a nearly horizontal position such that articles of clothing and the like may be draped thereover.

To selectively retain each of the arms 18 in a parallel relationship with respect to the center support member 12, a snap retainer is concentrically disposed upon the center support member and is operable to be releasably engaged to each of the arms when not in use. Additionally, a plurality of clips 20 may be slidably disposed upon each of the arms 18 and utilized for securing the associated articles of clothing to the arm.

In use, the collapsible portable radial clothes hanger 10 may be suspended from a shower curtain rod or other fixture through an engagement of the clamping hanger 14 to the same, thereby suspending the center support member 12 in a substantially vertical orientation. A selected number of the arms 18 may then be released from the snap retainer 22 and pivoted into a nearly horizontal, radially extending position. Articles of clothing or the like may then be suspended from each of the arms 18 for drying, displaying, or storing purposes.

More specifically, it will be noted that the collapsible portable radial clothes hanger 10 comprises a center support member 12 in which a clamping hanger 14 is connected to a top end thereof. The center support member 12 may be of any conceivable shape but is preferably constructed of a substantially round, tubular member which extends away from the clamping hanger 14 and supports a base 16 at a lower end thereof. The base 16 is substantially hemispherically shaped and is fixedly secured in a center of a flat surface thereof to the lower end of the center support member 12.

A plurality of arms 18 are each connected at an end thereof to a portion of the base 16, as best illustrated in FIG. 1. Each of the arms 18 is a substantially elongated rod member and may be constructed in such a manner so as define a hollow or solid interior. Additionally, the arms 18 may include contours which preclude a longitudinal movement of articles suspended thereover. Regardless of the shape of the arms 18, the arms are circumferentially arranged around a perimeter of the base 16, as shown in FIG. 1.

Because of their pivotal coupling to the base 16, the arms may be positioned in a parallel relationship with respect to the center support member 12 for travelling or storage purposes, or pivoted into a nearly horizontal, radially extending position such that articles of clothing and the like may be draped thereover. Preferably, the collapsible portable radial clothes hanger 10 includes ten of such arms 18, each of such arms being operable to pivot from a substantially parallel relationship with respect to the center support member 12 to a position less than 90 degrees therefrom, with the most preferable position being approximately 80 degrees from the center support member.

Figure 2:
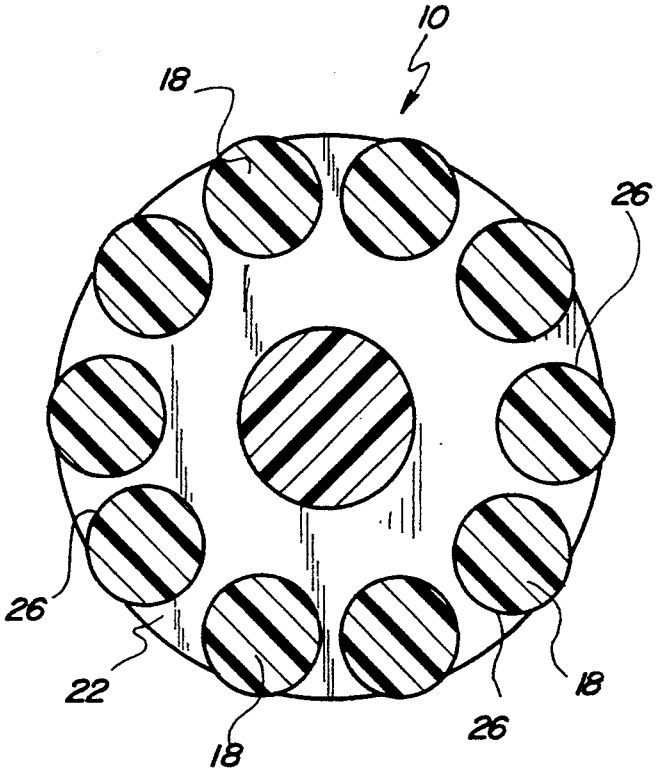
FIG. 2 is a cross sectional view taken along line 2—2 of FIG. 1.

To secure each of the arms 18 in a parallel relationship with respect to the center support member 12, a snap retainer 22 is concentrically positioned upon the center support member 12 and is operable to releasably capture a portion of each arm. As best illustrated in FIG. 2, the snap retainer 22 is a substantially circular member having a center aperture 24 through which the center support member 12 projects. A plurality of eccentric apertures 26 are positioned around a perimeter of the snap retainer 22 in such a manner so that each of the arms 18 may be laterally positioned into an appropriate eccentric aperture. The snap retainer 22 should be made of a substantially resiliently deformable material, such as rubber, soft plastic, or the like. The snap retainer 22 retains the arms 18 in their stored position and permits a user to selectively extend an appropriate number of arms for the task at hand.

Figure 3:
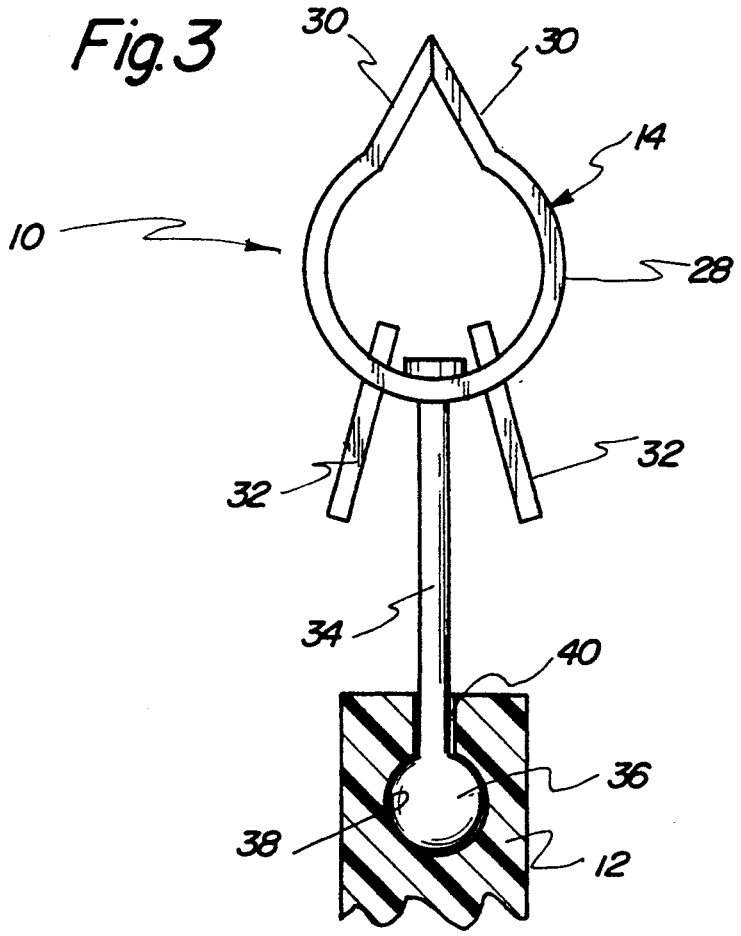
FIG. 3 is a further cross sectional view taken along line 3—3 of FIG. 1.

FIG. 3 illustrates the clamping hanger 14 and it can be seen from this Figure that the clamping hanger comprises a resilient C-shaped member 28 which defines a pair of cooperatively opposed jaws 30. A pair of levers 32 are coupled to the C-shaped member 28 and may be biased together to deform the C-shaped member and separate the jaws 30, whereby the clamping hanger 14 may then be attached to any conceivable fixture such as a shower curtain rod, a ceiling hook, a clothes line, a ceiling joist, or the like.

Extending from the resilient C-shaped member 28 is a rod 34 having a ball 36 at one end thereof. The ball 36 is operable to be received within a socket 38 formed in the center support member 12, whereby the rod 34 may extend through an aperture 40 in the center support member, thereby providing a pivotal and rotatable coupling between the center support member 12 and the clamping hanger 14. This arrangement allows the clothes hanger 10 to be rotated freely about a fixed support fixture.

Figure 4:
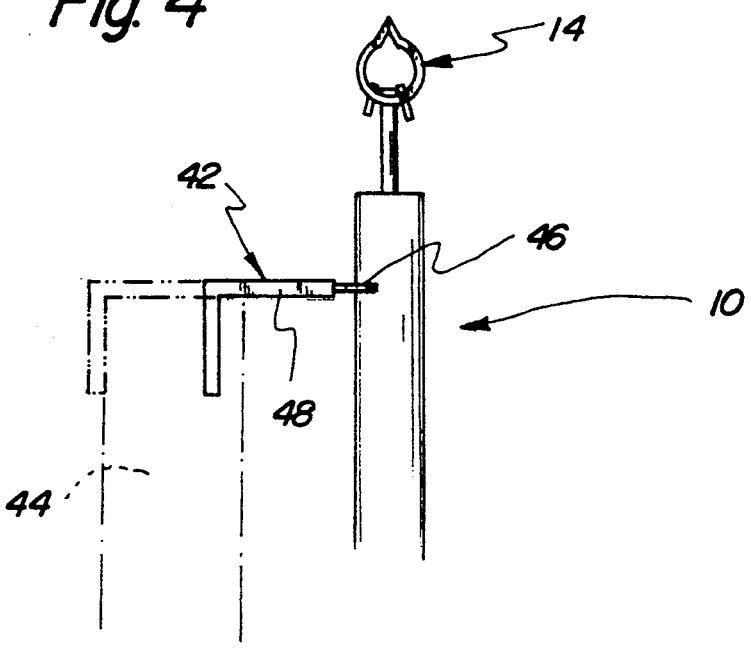
FIG. 4 is a side elevation view of a portion of the present invention.

Additionally or alternatively, the clothes hanger 10 may be provided with a door hanger 42 which allows the clothes hanger to be suspended from the top of a door 44 or other similar fixture. As best illustrated in FIG. 4, the door hanger 42 comprises a horizontal bracket 46 which is fixedly or otherwise secured in a substantially orthogonal manner to the center support member 12. An L-shaped member 48 is slidably disposed upon the horizontal bracket 46 and may be telescopically extended and positioned over the door 44. The telescoping relationship between the L-shaped member 48 and the horizontal bracket 46 allows the door hanger 42 to be compactly stowed for travelling or storage purposes.

Figure 5:
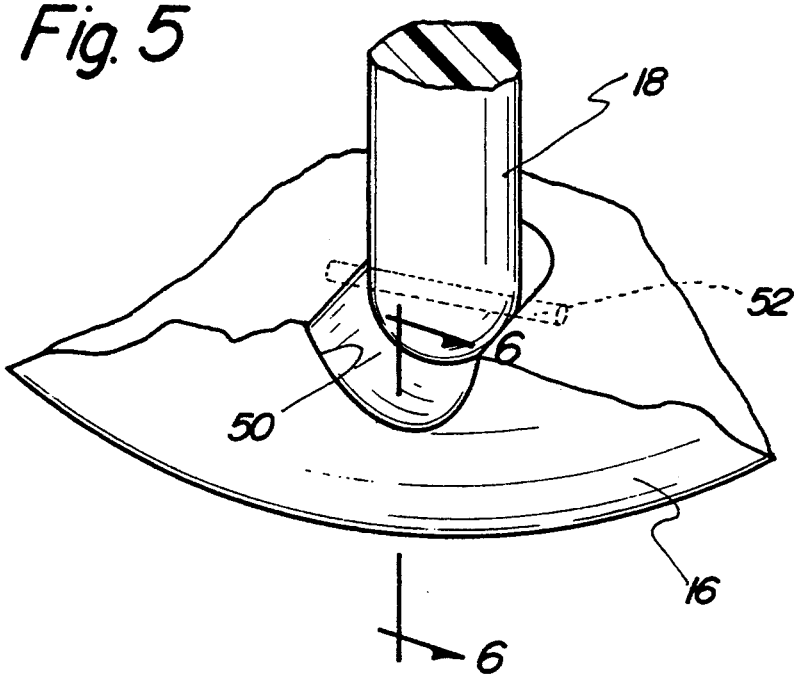
FIG. 5 is an enlarged perspective view of a further portion of the invention.
Figure 6:
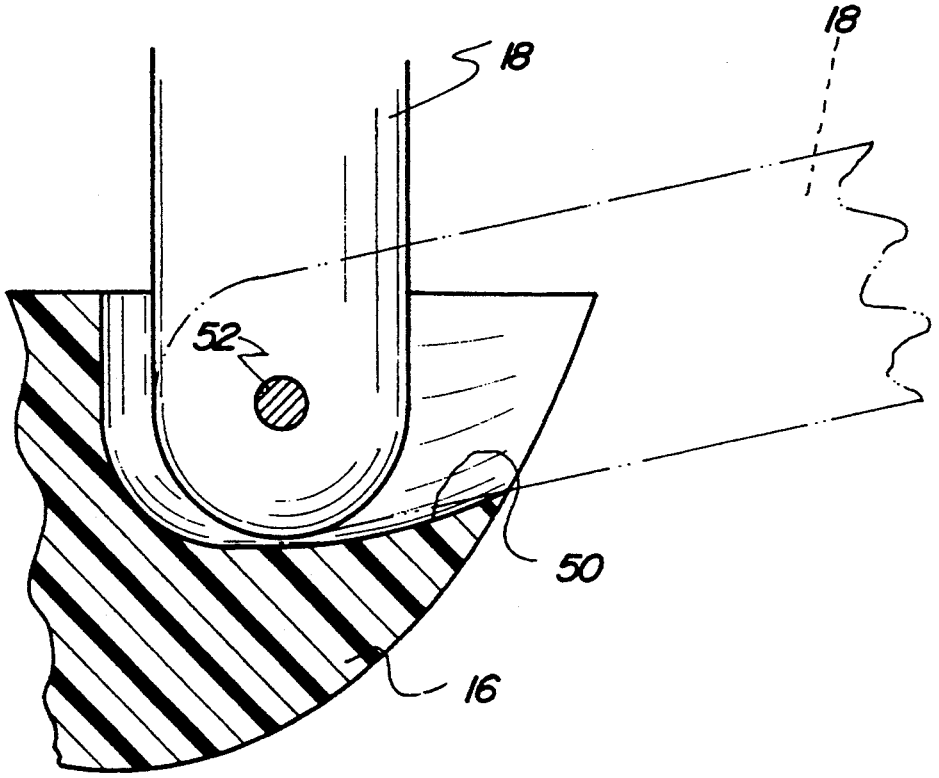
FIG. 6 is a cross sectional view taken along line 6—6 of FIG. 5.

FIGS. 5 and 6 illustrate the pivotal connection between each of the arms 18 and the base 16 and it can be seen from these Figures that each of the arms is mounted within a journal 50 formed within the base. As best illustrated in FIG. 6, the shape of the journal 50 determines the angle between each of the arms 18 and the center support member 12 when the arm is in an extended position. Stated again, each of the arms 18 should swing to less than 90 degrees away from the center support member 12, with the most preferable displacement being approximately 80 degrees therefrom. Although the shape of the journal 50 provides this limiting function, it is contemplated that a tether may be provided between each of the arms 18 and the center support member 12 to provide further support for each of the arms when they are extended. Finally, the arms 18 are each pivotally connected by a pivot pin 52 which extends through unlabeled apertures in both the base 16 and each of the arms 18 in a well understood manner.

In use, the collapsible portable radial clothes hanger 10 may be suspended from a shower curtain rod or other fixture through an engagement of the clamping hanger 14 to the same, thereby suspending the center support member 12 in a substantially vertical orientation. A selected number of the arms 18 may then be released from the snap retainer 22 and pivoted into a nearly horizontal, radially extending position. Articles of clothing or the like may then be suspended from each of the arms 18 for drying, displaying, or storing purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new collapsible portable radial clothes hanger comprising:

an elongated center support member having a top end and a lower end;

a base coupled to said lower end of said center support member, said base being generally circular and defining a periphery therearound;

a plurality of arms each having a pair of ends, each of said arms being pivotally connected at one of said ends to said base with at least one clip slidably disposed upon each of said arms;

a hanger means for suspending said center support member from a fixture;

a snap retainer concentrically positioned around said center support member for releasably capturing a portion of said arms; and a door hanger means for suspending said center support member from a top end of a door.

2. The new collapsible portable radial clothes hanger of claim 1, wherein said door hanger means comprises a horizontal bracket generally orthogonally coupled to said center support member; and an L-shaped member slidably disposed upon said bracket. disposed upon each of said arms.

3. The new collapsible portable radial clothes hanger of claim 2, wherein said center support member is shaped in such a manner so as to define a socket with an aperture extending from said socket to said top end of said center support member, and further wherein said clamping hanger comprises a resilient C-shaped member defining a pair of cooperatively opposed jaws; a pair of levers coupled to said C-shaped member for biasing said jaws apart; a rod pivotally coupled to said C-shaped member, said rod defining a ball at an end thereof, said ball being movably positioned within said socket.

4. The new collapsible portable radial clothes hanger of claim 3, wherein said base is shaped so as to define a plurality of journals around said periphery thereof, and further wherein said arms are each pivotally connected to said base and within one of said journals by a pivot pin.

5. The new collapsible portable radial clothes hanger of claim 4, wherein said plurality of arms comprises ten arms and further wherein said at least one clip comprises two clips.

6. The new collapsible portable radial clothes hanger of claim 5, wherein the angle between each of said arms and said center support member is generally not greater than 90 degrees.

7. The new collapsible portable radial clothes hanger of claim 6, wherein the angle between each of said arms and said center support member is generally 80 degrees.

* * * * *